United States Patent [19]

Desplats

[11] 4,438,659

[45] Mar. 27, 1984

[54] RELEASE MECHANISM FOR A TRACTION APPARATUS ACTING ON A CABLE WHICH PASSES THERETHROUGH

[75] Inventor: André Desplats, Boulogne Billancourt, France

[73] Assignee: Tractel S.A., France

[21] Appl. No.: 396,540

[22] Filed: Jul. 8, 1982

[30] Foreign Application Priority Data

Jul. 9, 1981 [FR] France ..... 81 13553

[51] Int. Cl.[3] ..... G05G 5/06

[52] U.S. Cl. ..... 74/529; 74/540; 188/65.1

[58] Field of Search ..... 74/529, 527, 540, 542; 254/251; 182/5; 188/65.1; 24/273, 132 WL, 134 N, 248 B, 248 E, 222, 223

[56] References Cited

U.S. PATENT DOCUMENTS 2,489,632 11/1949 Freider et al. ..... 188/65.1
3,304,107 2/1967 Bahmüller ..... 74/540
3,732,598 5/1973 Hatay ..... 24/134 N
3,916,487 11/1975 Rinio ..... 24/134 N
3,975,972 8/1976 Muhleck ..... 74/529

FOREIGN PATENT DOCUMENTS 914400 9/1945 France .

*Primary Examiner*—Leslie A. Braun
*Assistant Examiner*—Anthony W. Raskob, Jr.
*Attorney, Agent, or Firm*—William A. Drucker

[57] ABSTRACT

A release mechanism is provided ensuring simultaneous opening of the two clamps of a traction apparatus for freeing the cable which passes therethrough.

The release lever is mounted for longitudinal sliding by actuation of the handle while moving the intermediate pin carried by the warping out lever. A pivoting bolt, mounted in a widened end of a longitudinal oblong slit of said lever, prevents the release movement. The release can only be obtained when the user frees said bolt with one hand against the return action of a spring and, with the other hand, operates simultaneously said handle.

2 Claims, 4 Drawing Figures

RELEASE MECHANISM FOR A TRACTION APPARATUS ACTING ON A CABLE WHICH PASSES THERETHROUGH

BACKGROUND OF THE INVENTION

The invention relates to traction apparatus acting on a cable through two self-clamping clamps with reverse alternating movements for warping the cable in and out. It relates more particularly to the construction of the release mechanism which provides simultaneous opening of the two clamps to allow the cable to be inserted in the apparatus or removed therefrom.

An apparatus of this type is described for example in French Pat. No. 914 400 of Sept. 5, 1945. In this kind of apparatus, the release operation is obtained by acting on the middle point of the so-called warping out or reverse operation lever, this lever being connected to the end of the links of each clamp. The action on the warping out lever may take place, depending on the construction thereof, by pushing, pulling or even rotating a member called release lever whose initial movement suitably transformed into a translational movement in the desired direction, will provide simultaneous opening of the two clamps.

SUMMARY OF THE INVENTION

The object of the invention is to make impossible the accidental operation of the release lever and, to this end, it provides a mechanism whose actuation, at least in the initial phase of the movement, requires the simultaneous use of both hands of the user. In fact, the mechanism of the invention comprises, on the one hand, a release lever integral with one end of a release control handle and cooperating at its other end with the middle point of the warping out lever so, by effecting a longitudinal translational movement following a push by the user with his hand on the handle, as to move the middle point of the warping out lever in the direction ensuring simultaneous opening of the clamps and, on the other, a bolt which is returned by a spring into a position in which it opposes said longitudinal movement of the release lever and which is intended to be actuated by the other hand of the user so as to permit the longitudinal movement of the release lever.

The release control handle has a form specially designed so as to obtain the following result:

(a) to allow, through the form of its rear part, the push required for release to be conveniently exerted with the palm of the hand along a suitable path, (b) to allow, by profiling of its front part, the fingers to be conveniently placed with a view to carrying the apparatus; moreover, the center of gravity of the apparatus is naturally aligned in the extension of the arm of the user.

BRIEF DESCRIPTION OF THE DRAWINGS

So as to better understand the mechanism forming the subject of the present invention, a preferred embodiment will be described hereafter with reference to the accompanying schematic drawings in which.

DESCRIPTION OF THE PREFERRED EMBODIMENT

Figure 1:
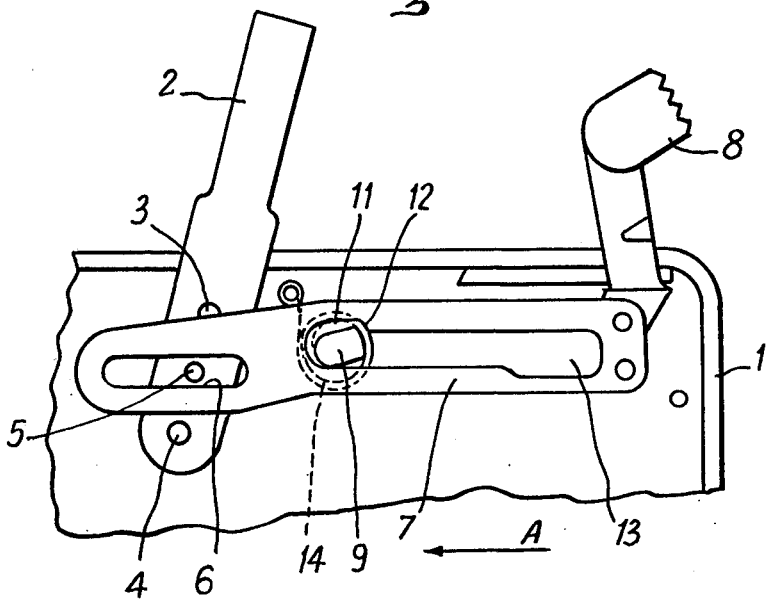
FIG. 1 is a partial side view of a traction apparatus equipped with a release mechanism in accordance with the invention.

In FIG. 1 there is shown, inside the casing 1 of a traction apparatus, the warping out lever 2 having a pin 3 for connection thereof with the control links of a clamp (not shown) and a pin 4 for connection thereof with the control links of the other clamp (not shown). Half way between pins 3 and 4, the warping out lever 2 comprises a pin 5 housed in an oblong opening 6 in the front end of a release lever 7 mounted so as to be able to slide longitudinally inside casing 1. The rear end of release lever 7 is integral with a release control handle 8 intended, when pushed by the hand of the user, to slide longitudinally between the cheeks of casing 1 while driving the release lever 7 in the direction of arrow A so that the rear end of the oblong slit 6 engages with the pin 5 of the warping out lever 2 while moving this pin 5 leftwards and thus ensuring simultaneous opening of the two clamps of the apparatus.

Figure 2:
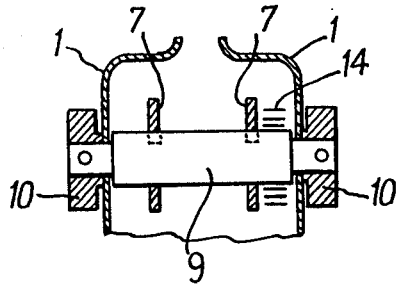
FIG. 2 is a cross view showing the bolt equipped with its lateral actuating members.
Figure 3:
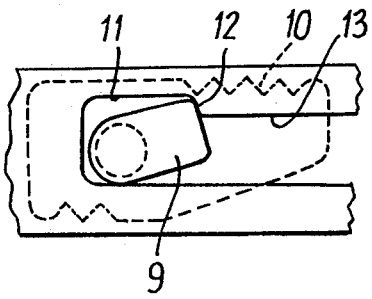
FIG. 3 shows the bolt in its position preventing release.

In casing 1 there is transversely mounted a bolt 9 adapted to be able to pivot about a horizontal axis and which presents externally (see FIG. 2) on each side of casing 1, an actuating member 10. This bolt 9 is disposed inside the front end of another longitudinal oblong opening 11 in the release lever 7, which is continued, after a shoulder 12, by a part 13 of reduced width which is however slightly greater than the height of bolt 9. With this bolt 9 there is associated a spring 14 which forces it towards its high position, shown in FIGS. 1 and 3, in which this bolt restrains shoulder 12 while preventing movement of the release lever 7 in the direction of arrow A of FIG. 1 and then preventing release of the apparatus.

Figure 4:
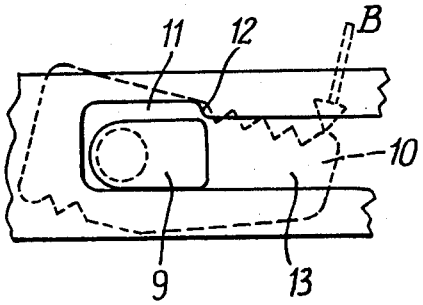
FIG. 4 is a view similar to FIG. 3 showing the bolt forced into its position allowing release.

It will be understood that, so as to be able to effect release of the apparatus, the user will have to apply a pressure with one hand in the direction of arrow B of FIG. 4, on one of the actuating members 10 of bolt 9 so as to cause this latter to pivot clockwise while freeing it from shoulder 12 and bringing it, against the action of spring 14, into the axis of part 13 of slit 11 and, simultaneously with the other hand, he will have to push handle 8 which will then allow release lever 7 to move thus ensuring simultaneous opening of the clamps.

The mechanism of the invention, by requiring for actuation thereof the simultaneous actions of both hands of the user, thus practically removes the risk of accidental release, which, in this type of apparatus, could have serious consequences.

As can be seen, the release control handle 8 has a rear part whose shape is adapted to allow the user to conveniently exert, with the palm of his hand and following a suitable path, the push required for release. The front part of handle 8 is shaped so as to allow convenient positioning of the fingers of the user for carrying the apparatus, the orientation of this handle being furthermore provided so that, in the carrying position, the center of gravity of the apparatus is naturally aligned with the extension of the arm of the user.

It will be readily understood that the above description has been given by way of simple example without any limiting character and that additions or constructional modifications could be made thereto without departing from the scope or spirit of the invention defined by the accompanying claims.

What is claimed is:

1. In a traction apparatus acting on a cable through two self-clamping jaws by operating either a warping in lever or a warping out lever, the improvement comprising a release mechanism which comprises:

(a) a release lever adapted to longitudinally move in the direction of a longitudinal axis of the apparatus, said release lever presenting:

(b) a front end portion provided with a first longitudinal slit within which engages a pin carried by said warping out lever, and (c) an intermediate portion provided with another longitudinal slit comprising a portion of reduced width followed by a portion of larger width, (d) a release control handle rigid with said release lever, and (e) a locking mechanism which comprises:

(f) a bolt disposed transversely to the apparatus and passing through said portion of larger width of said other longitudinal slit of the release lever, said bolt being adapted to rotate in registering openings of a casing of the apparatus, (g) a spring co-acting with said bolt to urge same in a locking position in which said bolt engages a shoulder separating the two portions of different width of the other longitudinal slit, thus preventing to move the release lever in a release direction by sliding along said bolt, and (h) an actuating member extending outside of the casing of the apparatus and rigid with at least one end of the bolt, said actuating member being adapted to be rotated by a user's hand, against the action of said spring, to move said bolt from its locking position to a position in which the bolt is directed along the axis of said another longitudinal slit of the release lever and allows a longitudinal movement of the release lever, so that the release mechanism can be actuated only by pivoting the actuating member of the locking mechanism with one hand of the user while simultaneously the other hand of the user acts on the release control handle to cause the longitudinal movement of the release lever in the release direction thus avoiding any risk of accidental actuation of the release mechanism.

2. In a traction apparatus, the improvement comprising a release mechanism according to claim 1, wherein said release control handle has a rear part having a shape allowing actuation thereof by a palm of hand of the user, said handle presenting a front part which is profiled to allow convenient positioning of fingers of the user with a view to carrying the apparatus.

* * * * *